US006598874B2

(12) United States Patent
Hachmann et al.

(10) Patent No.: US 6,598,874 B2
(45) Date of Patent: Jul. 29, 2003

(54) METHOD AND DEVICE FOR CONTACT-FREE RETENTION OF SHEETS

(75) Inventors: Peter Hachmann, Dossenheim (DE); Uwe Tessmann, Nussloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 31 days.

(21) Appl. No.: 10/010,502

(22) Filed: Dec. 5, 2001

(65) Prior Publication Data

US 2002/0084582 A1 Jul. 4, 2002

(30) Foreign Application Priority Data

Dec. 5, 2000 (DE) ..... 100 60 270
Sep. 11, 2001 (DE) ..... 101 45 101

(51) Int. Cl.[7] ..... B65H 5/02; B65H 29/24

(52) U.S. Cl. ..... 271/276; 271/295; 101/416.1; 101/420

(58) Field of Search ..... 271/275, 276, 271/194, 195; 101/416.1, 420; B65H 5/02, 29/24

(56) References Cited

U.S. PATENT DOCUMENTS 3,272,415 A 9/1966 Wallin
5,988,633 A * 11/1999 Henn et al. ..... 271/204
6,435,088 B2 * 8/2002 Fujimoto ..... 101/232
2001/0038177 A1 * 11/2001 Spurk ..... 271/195

FOREIGN PATENT DOCUMENTS

DE 1 474 214 3/1969
DE 40 14 780 A1 12/1990
DE 198 15 794 A1 10/1998
DE 198 22 058 A1 11/1999

* cited by examiner

*Primary Examiner*—Donald P. Walsh
*Assistant Examiner*—Kenneth W. Bower
(74) *Attorney, Agent, or Firm*—Laurence A. Greenberg; Werner H. Stemer; Ralph E. Locher

(57) ABSTRACT

A method of retaining a sheet on at least one of a transfer cylinder and a guide surface of a sheet-guiding device in a sheet-processing machine by pneumatically activatable nozzles for producing an air cushion beneath the respective sheet, which comprises producing an air cushion by an air-pressure distribution resulting in air flows beneath the respective sheet, the air-pressure distribution being based virtually only on radially decelerated air flow, and being capable of retaining the respective sheet in position; and a retaining device for performing the method.

16 Claims, 6 Drawing Sheets

METHOD AND DEVICE FOR CONTACT-FREE RETENTION OF SHEETS

BACKGROUND OF THE INVENTION

FIELD OF THE INVENTION

The invention relates to a method and device for contact-free retention of sheets on the circumferential surface of a cylinder or a planar guiding surface of a sheet-processing machine, in particular, a sheet-fed rotary printing machine.

The published German Patent Document DE 198 15 794 A1 has already disclosed heretofore a practice of installing, on a transfer cylinder of a sheet-processing machine, blowing/suction elements which subject to suction action a sheet transported primarily by grippers, and thus retain the sheet on the circumferential surface of the cylinder. The blowing or blast air that is applied here flows out parallel to and beneath the sheet and, assisted by suitably provided suction openings, against the cylinder body. In the case of sheets which are freshly printed on the reverse side thereof, contact between the sheet and the cylinder body may result in smearing problems.

SUMMARY OF THE INVENTION

It is accordingly an object of the invention to provide a method and a device for implementing the method, by which, on a sheet-transporting cylinder or a guiding surface in a sheet-processing machine, the sheet is subjected to retaining forces which retain the sheet in a more-or-less contact-free manner in the vicinity of the circumferential surface of the cylinder or of the sheet-guiding surface.

With the foregoing and other objects in view, there is provided, in accordance with one aspect of the invention, a method of retaining a sheet on at least one of a transfer cylinder and a guide surface of a sheet-guiding device in a sheet-processing machine by pneumatically activatable nozzles for producing an air cushion beneath the respective sheet, which comprises producing an air cushion by an air-pressure distribution resulting in air flows beneath the respective sheet, the air-pressure distribution being based virtually only on radially decelerated air flow, and being capable of retaining the respective sheet in position.

In accordance with another mode, the method of the invention includes producing an air pressure adapted to the weight per unit area of the sheet.

In accordance with a further mode, the method of the invention includes setting the air pressure at between 5,000 and 500,000 pascals.

In accordance with another aspect of the invention, there is provided a device for retaining sheets on at least one of a transfer cylinder and a guide surface of a sheet-guiding device in a sheet-processing machine, comprising pneumatically activatable nozzles for producing an air cushion beneath the respective sheets, the nozzles having respective central blast-air openings as a center thereof, and an outflow feature selected from the group consisting of outflow openings arranged in a circle around the center and at least one outflow channel.

In accordance with a further aspect of the invention, there is provided a device for retaining sheets on at least one of a transfer cylinder and a guide surface of a sheet-guiding device in a sheet-processing machine, comprising pneumatically activatable nozzles for producing an air cushion beneath the respective sheets, the nozzles constituting a swivel nozzle as a center, and an outflow feature selected from the group consisting of outflow openings arranged in a circle around the center and at least one outflow channel.

In accordance with another feature of the invention, the blast-air opening is a borehole, and the outflow openings are boreholes.

In accordance with a further feature of the invention, the swivel nozzle has at least two boreholes which are offset relative to one another and are inclined relative to an outlet surface.

In accordance with an added feature of the invention, an angle smaller than 60° is enclosed by the boreholes, respectively, and the outlet surface.

In accordance with an additional feature of the invention, the boreholes have an angular offset from one another at least approximately resulting from a division corresponding to the number of boreholes.

In accordance with yet another feature of the invention, the blast-air opening is connected to a pressure source, and the outflow openings are connected to atmosphere.

In accordance with yet a further feature of the invention, the swivel nozzle is connected to a pressure source, and the outflow openings are connected to atmosphere.

In accordance with yet an added feature of the invention, the blast-air opening is a ring-gap nozzle.

In accordance with yet an additional feature of the invention, the ring-gap nozzle is formed of a number of boreholes arranged in a circle.

In accordance with still another feature of the invention, the blast-air openings are able to be supplied with a pressure of from 5,000 to 500,000 pascals.

In accordance with still a further feature of the invention, the swivel nozzles are able to be supplied with a pressure of from 5,000 to 500,000 pascals.

In accordance with a concomitant feature of the invention, the sheet-processing machine is a rotary printing machine.

A particular advantage of the invention is that of retaining the sheet on an air cushion produced by a free blast-air jet which produces an air flow beneath the sheet and, utilizing the hydrodynamic paradox, subjects the sheet to a retaining force. In particular, when used on transfer cylinders wherein the freshly printed side of the sheet is directed towards the circumferential surface of the cylinder, the method and device according to the invention avoid smearing of the fresh ink on the cylinder. When the invention is applied to a storage drum, the sheet can be clamped easily by transfer systems acting upon the trailing edge thereof.

A further location for a planar sheet-guiding surface used with the invention is, for example, a feed table, in which case the sheet is aligned initially at the leading edge thereof and then laterally. So-called front blowers, which blow on the leading edge of the sheet counter to the sheet-transporting direction, aid the separation from a following sheet of the sheet which is to be aligned. In order that the sheet which is to be aligned is not blown upwardly from the feed table, however, provision is made for applying the method and device according to the invention in order, on the one hand, to retain the sheet on the feed table and, on the other hand, to facilitate the lateral alignment thereof on an air cushion.

Other features which are considered as characteristic for the invention are set forth in the appended claims.

Although the invention is illustrated and described herein as embodied in a method and device for a contact-free retention of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
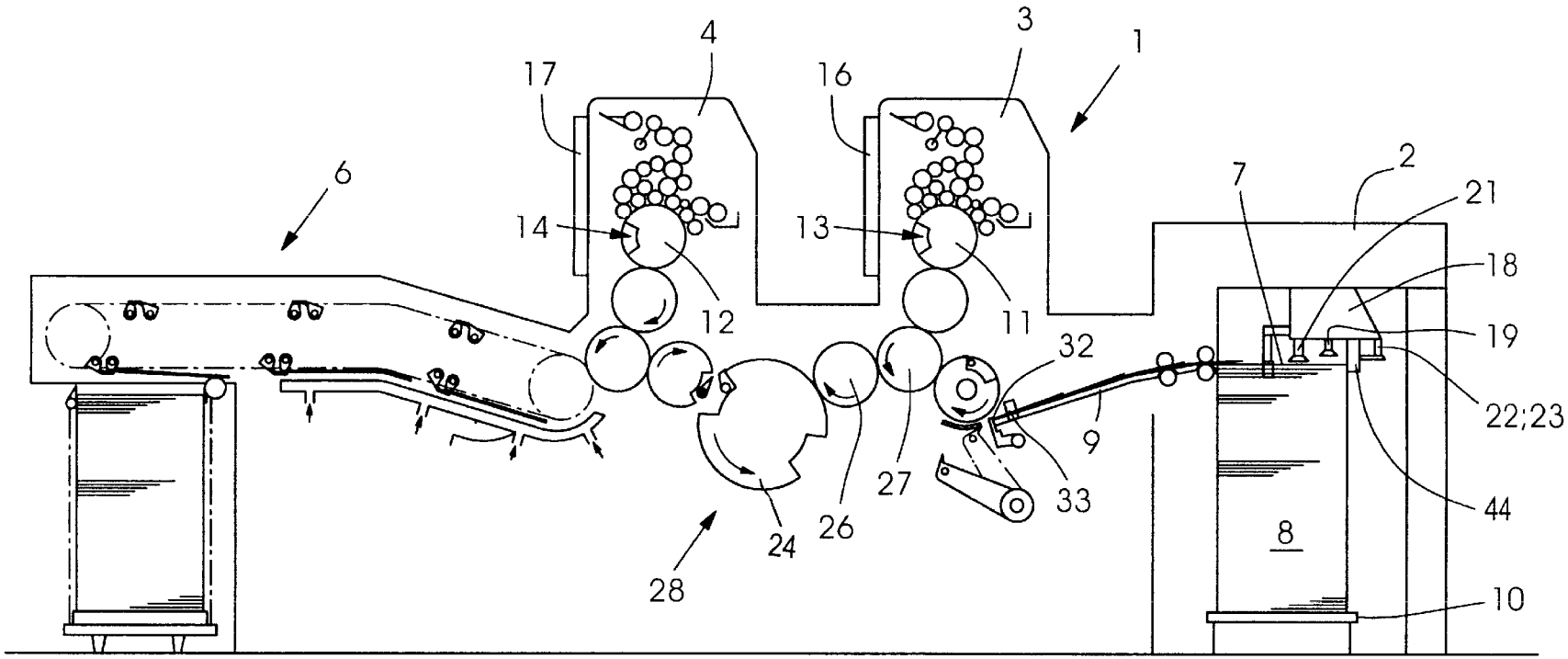
FIG. 1 is a diagrammatic side elvational view of a rotary printing machine incorporating the device according to the invention.

Referring now to the drawings and, first, particularly to FIG. 1 thereof, there is shown therein a rotary printing machine, e.g., a printing machine 1 for processing sheets 7, having a feeder 2, at least one printing unit 3, 4 and a delivery 6. The sheets 7 are removed from a sheet pile 8 and fed separately or in imbricated form to the printing units 3 and 4 via a feed table 9. The printing units, respectively, include, in a conventional manner, a plate cylinder 11, 12. The plate cylinders 11 and 12, respectively, have a device 13, 14 for fastening flexible printing plates thereon. Furthermore, each plate cylinder 11, 12 has assigned thereto a respective device 16, 17 for semi-automatically or fully automatically changing printing plates.

The sheet pile 8 lies on a pile or stack support plate 10 which can be raised controllably. The sheets 7 are removed from the upper side of the sheet pile 8 by a so-called suction head 18 which, amongst others, has a number of lifting and pull suckers 19, 21 for singling or separating the sheets 7. Also provided are blowing or blast devices 22 for loosening the top sheet layers, and feeler or sensing elements 23 for pile adjustment. In order to align the sheet pile 8, particularly the top sheets 7 of the sheet pile 8, a number of lateral and rear stops are provided. Furthermore, a turning or reversing device 28 is provided between the first printing unit 3 and a second printing unit 4, the turning device 28 being selectively or optionally activatable, so that it is possible to operate both in recto printing mode and in recto/verso printing mode.

Figure 2:
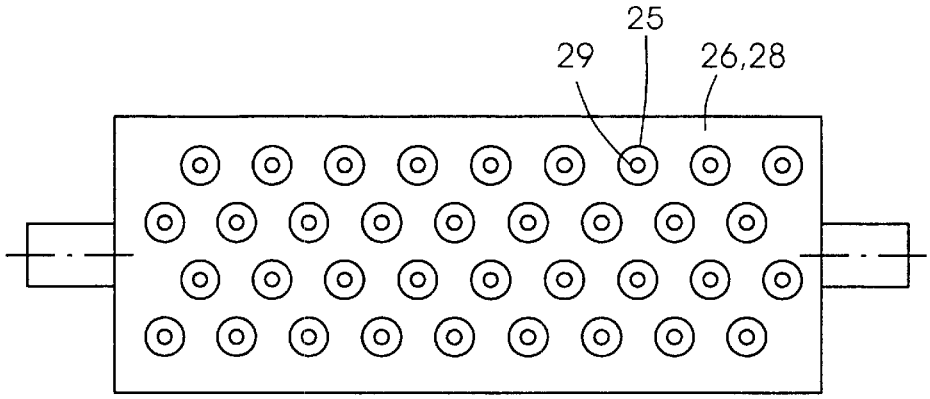
FIG. 2 is a diagrammatic plan view of a transfer cylinder incorporating the device according to the invention.
Figure 5A:
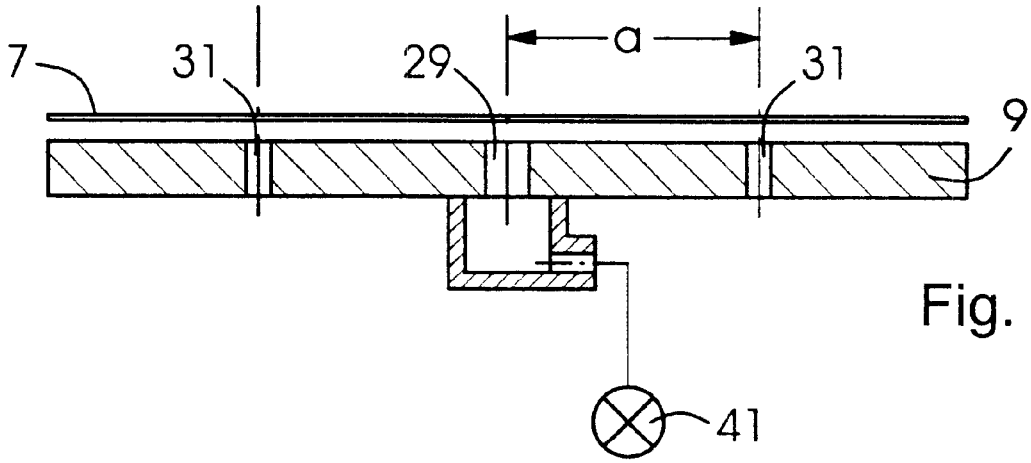
FIGS. 5*a* and 5*b* are sectional and plan views, respectively, of another embodiment of the retaining nozzle.
Figure 5B:
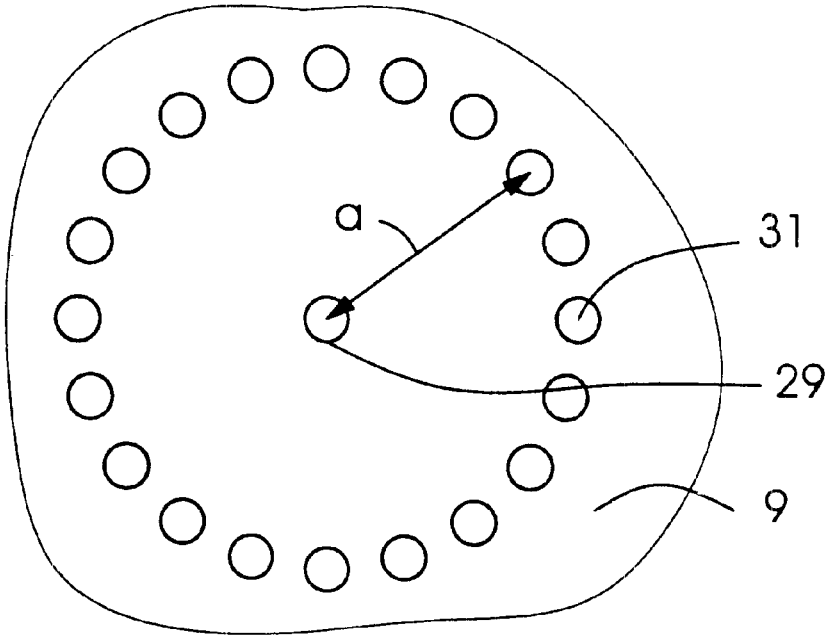

A transfer cylinder 26 is located between an impression cylinder 27 of the first printing unit 3 and a storage drum 24 of the turning device 28. As shown in greater detail in FIG. 2, the transfer cylinder 26 has distributed over the circumferential jacket surface thereof a number of retaining nozzles 25 provided with a blast or blowing-air opening 29 which is enclosed, respectively, and, as shown in FIG. 5*b*, by a number of outflow openings 31, a distance a between a respective blast-air opening 29 and a respective outflow opening 31 being constant, resulting in a circular arrangement of the outflow openings 31, with the blast-air opening 29 as a center point. The blast-air opening 29 is arranged so that the free blast-air jet from the mouth of the blast-air opening passes out approximately perpendicularly to the sheet transporting plane or radially from the cylindrical jacket surface until it comes into contact with the sheet 7 which is to be retained.

Figure 3:
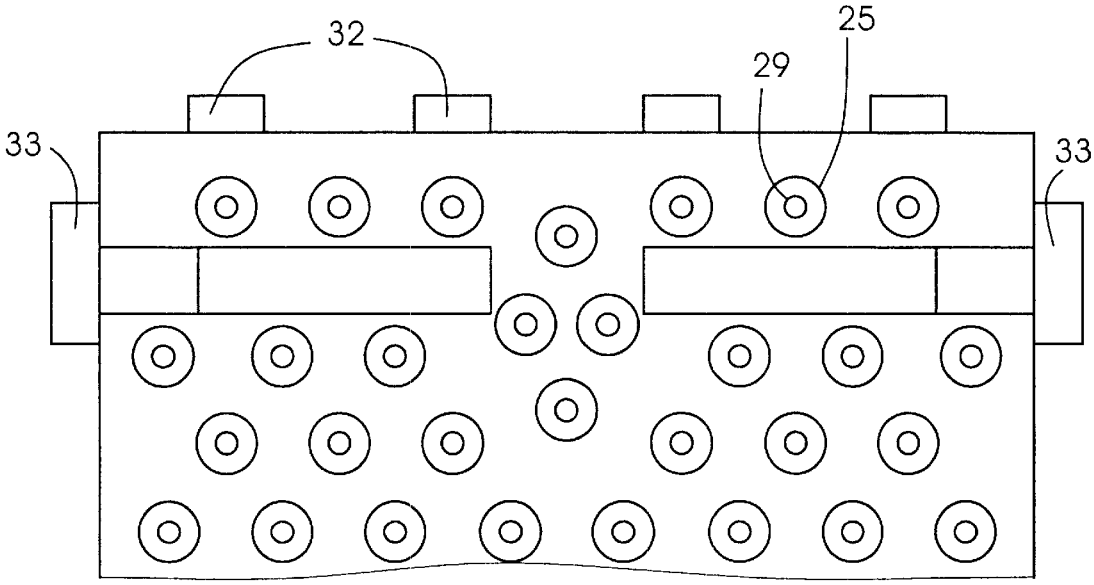
FIG. 3 is a diagrammatic plan view of the feeding region of a sheet-feeding table incorporating the device according to the invention.

The feed table 9 is proposed as an example for arranging the retaining nozzles 25 according to the invention on a planar transporting surface. Provision is thereby made, as shown in FIG. 3, for arranging the retaining nozzles 25 according to the invention in the front region of the feed table 9 in the vicinity of front guides 32 and pull-type side guides 33, i.e., in the non-imbricated region of the sheet 7.

Figure 4A:
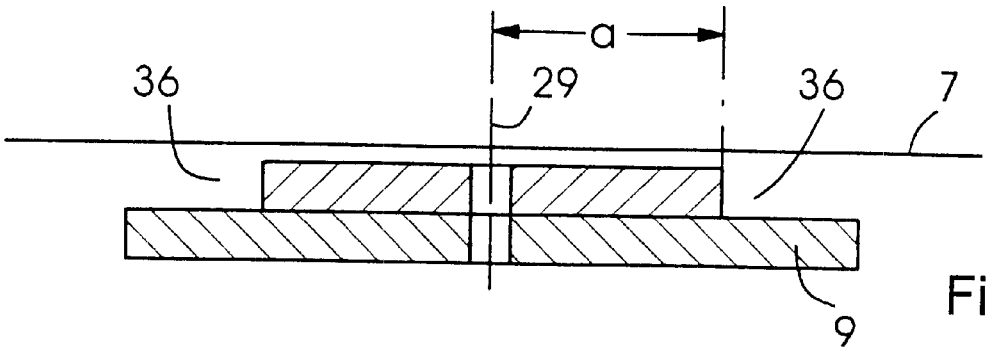
FIGS. 4*a* and 4*b* are sectional and plan view, respectively, of one embodiment of a retaining nozzle according to the invention.
Figure 4B:
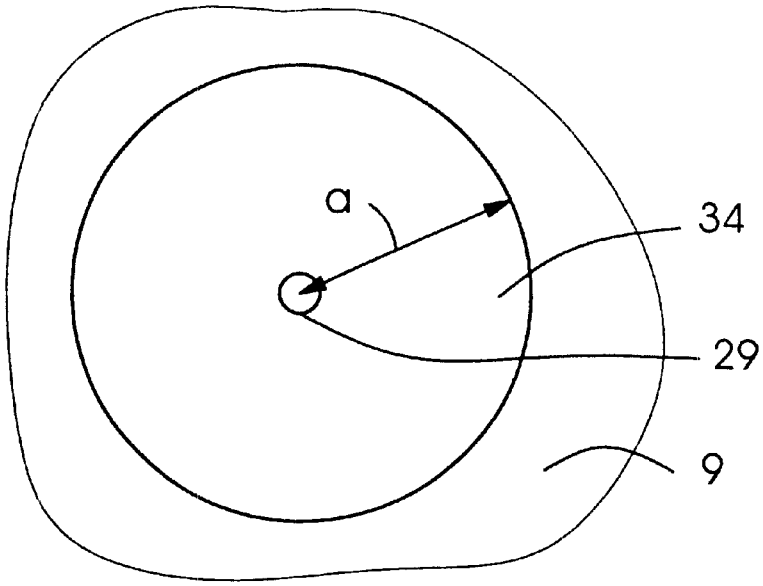

According to the embodiment of FIGS. 4*a* and 4*b*, the retaining nozzles 25 are formed from a circular element 34 which is raised in relation to the guide surface of the feed table 9 or of the jacket surface of the transfer cylinder 26, and has a free-jet blowing opening 35 in the center. In this embodiment, the necessary outflow channel 36 is formed by the space which is formed by the guide plane, an edge of the circular element 34 and the sheet 7.

Figure 6:
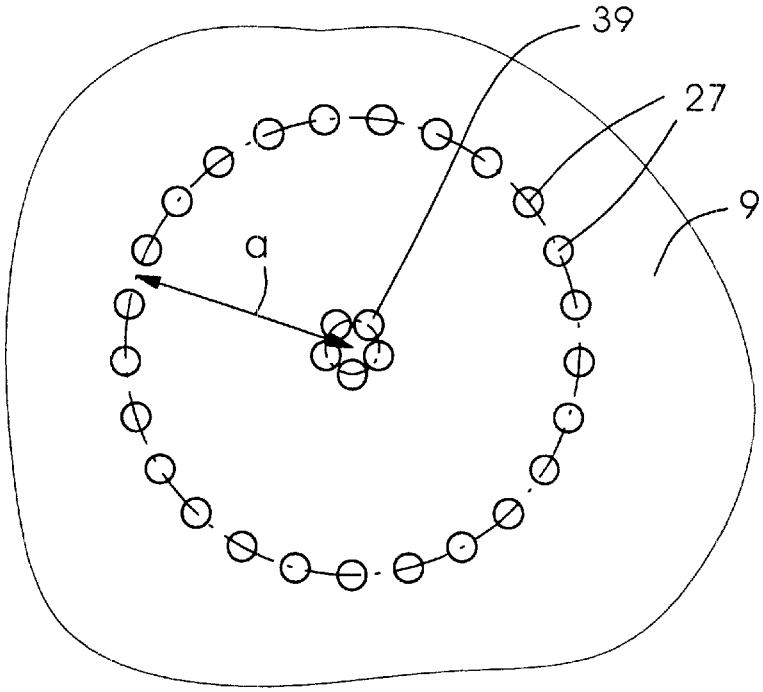
FIGS. 6 and 7 are plan views of additional embodiments, respectively, of the retaining nozzle.
Figure 7:
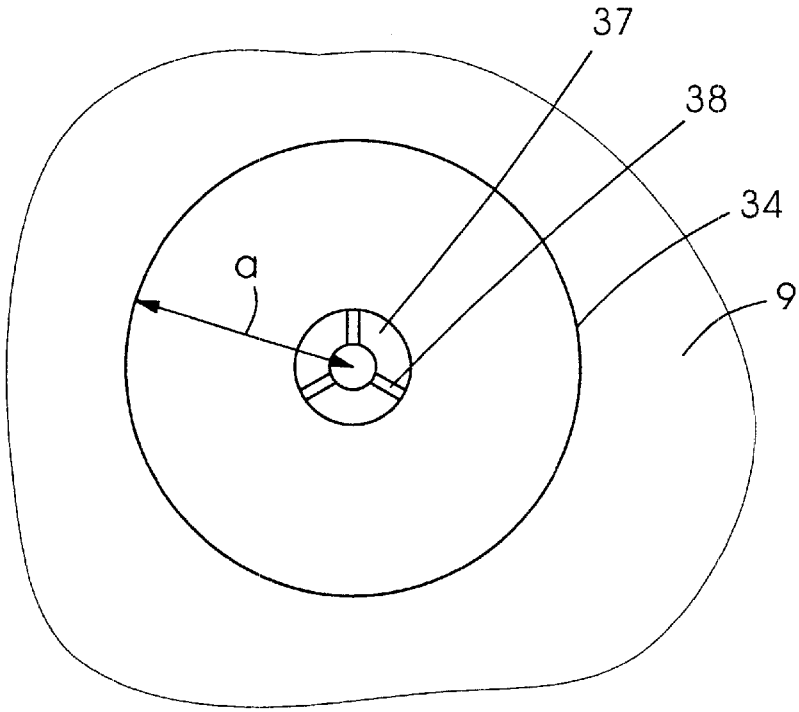

In another embodiment, provision is made for using an annular or ring gap 37 as the blast-air opening, the gap 37 having one or more crosspieces 38 (FIG. 7) or, in a further embodiment, the blast-air opening is produced by a number of boreholes 39 (FIG. 6) arranged closely together.

Figure 8A:
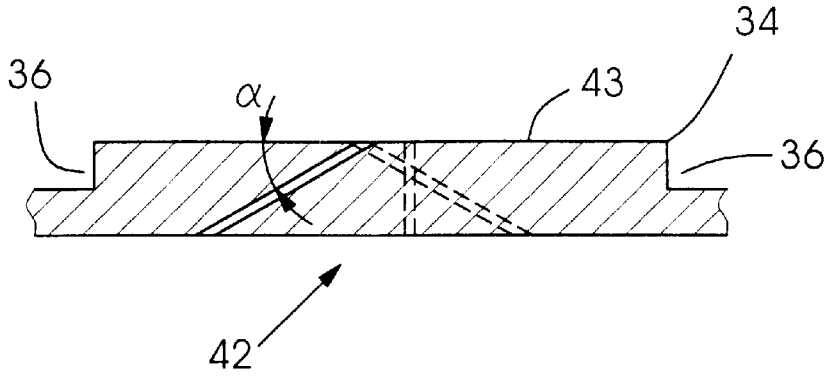
FIGS. 8*a* and 8*b* are sectional and plan views, respectively, of yet another embodiment of the retaining nozzle.
Figure 8B:
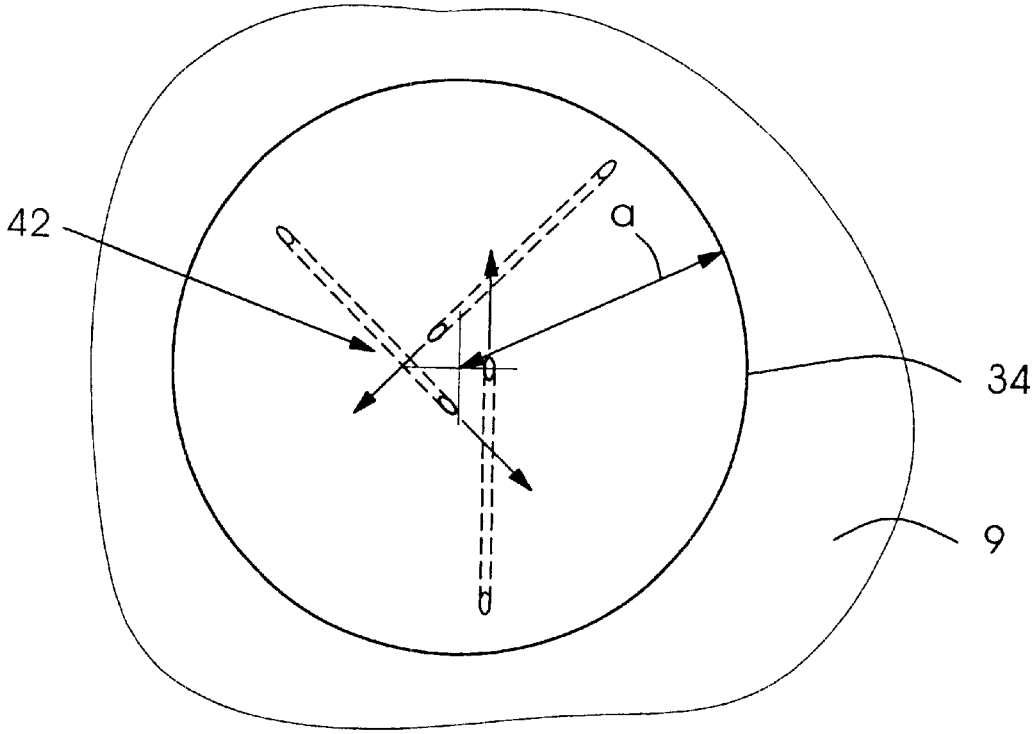

In an additional embodiment, as shown in FIGS. 8*a* and 8*b*, the blast-air opening that is provided is a swivel nozzle which comprises at least two boreholes offset ideally 180° from one another. The boreholes are at an angle $\alpha$ ($\alpha<60°$), ideally $\alpha$ is approximately 30°, to the outlet surface 43. The exemplary embodiment according to FIG. 8 thus has a swivel nozzle 42 formed with three boreholes offset 120° from one another. It is also possible for the number of boreholes of this swivel nozzle to be greater, although the angular offset between the boreholes should be a divisor of 360° which is determined by the number of boreholes, e.g., 5 boreholes result in an angular offset of 360°/5=72°.

The blast-air opening 29 or swivel nozzle 42 is activated by a compressed-air source 41 (note FIG. 5*a*) with a low air pressure p=approximately 5000 pascals to p=approximately 500,000 pascals. The free air jet produced here passes centrally perpendicularly out of the blast-air opening 29, or at an angle in the case of the swivel nozzle 42, comes into contact with the sheet 7 and spreads out approximately parallel to the sheet 7 and the guide surface until the free air jet reaches the outflow openings 31. This produces a radially decelerated air flow, a hydrodynamic paradox, which results in the sheet 7 being retained in a contact-free manner.

The instant that the distance between the sheet and the retaining nozzle 25 drops below a maximum, the sheet is attached by suction by the retaining nozzle 25. If this distance decreases to a minimum distance, the pressure beneath the sheet increases so that the sheet 7 is forced away from the retaining nozzle 25. This measure establishes a floating state of the sheet.

We claim:

1. A method of retaining a sheet on at least one of a transfer cylinder and a guide surface of a sheet-guiding device in a sheet-processing machine by pneumatically activatable nozzles for producing an air cushion beneath the respective sheet, which comprises producing an air cushion by an air-pressure distribution resulting in air flows beneath the respective sheet, the air-pressure distribution being based virtually only on radially decelerated air flow, and being capable of retaining the respective sheet in position.

2. The method according to claim 1, which includes producing an air pressure adapted to the weight per unit area of the sheet.

3. The method according to claim 2, which includes setting the air pressure at between 5,000 and 500,000 pascals.

4. A device for retaining sheets on at least one of a transfer cylinder and a guide surface of a sheet-guiding device in a sheet-processing machine, comprising pneumatically activatable nozzles for producing an air cushion beneath the respective sheets, said nozzles having respective central blast-air openings as a center thereof, and an outflow feature selected from the group consisting of outflow openings arranged in a circle around said center and at least one outflow channel.

5. The retaining device according to claim 4, wherein said blast-air opening is a borehole, and said outflow openings are boreholes.

6. The retaining device according to claim 4, wherein said blast-air opening is connected to a pressure source, and said outflow openings are connected to atmosphere.

7. The retaining device according to claim 4, wherein said blast-air openings are able to be supplied with a pressure of from 5,000 to 500,000 pascals.

8. The retaining device according to claim 4, wherein the sheet-processing machine is a rotary printing machine.

9. The retaining device according to claim 4, wherein said blast-air opening is a ring-gap nozzle.

10. The retaining device according to claim 9, wherein said ring-gap nozzle is formed of a number of boreholes arranged in a circle.

11. A device for retaining sheets on at least one of a transfer cylinder and a guide surface of a sheet-guiding device in a sheet-processing machine, comprising pneumatically activatable nozzles for producing an air cushion beneath the respective sheets, said nozzles constituting a swivel nozzle as a center, and an outflow feature selected from the group consisting of outflow openings arranged in a circle around said center and at least one outflow channel.

12. The retaining device according to claim 11, wherein said swivel nozzle is connected to a pressure source, and said outflow openings are connected to atmosphere.

13. The retaining device according to claim 11, wherein said swivel nozzles are able to be supplied with a pressure of from 5,000 to 500,000 pascals.

14. The retaining device according to claim 11, wherein said swivel nozzle has at least two boreholes which are offset relative to one another and are inclined relative to an outlet surface.

15. The retaining device according to claim 14, wherein an angle smaller than 60° is enclosed by said boreholes, respectively, and said outlet surface.

16. The retaining device according to claim 14, wherein said boreholes have an angular offset from one another at least approximately resulting from a division corresponding to the number of boreholes.

* * * * *